US012049795B2

(12) United States Patent
Gunasekaran et al.

(10) Patent No.: US 12,049,795 B2
(45) Date of Patent: Jul. 30, 2024

(54) INTEGRATION OF STORED KINETIC ENERGY IN DOWNHOLE ELECTRICAL INTERVAL CONTROL VALVES

(71) Applicant: Halliburton Energy Services, Inc., Houston, TX (US)

(72) Inventors: Mohan Gunasekaran, Singapore (SG); Paul James, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/963,893

(22) Filed: Oct. 11, 2022

(65) Prior Publication Data

US 2024/0117698 A1 Apr. 11, 2024

(51) Int. Cl.
*E21B 34/14* (2006.01)
*E21B 31/107* (2006.01)

(52) U.S. Cl.
CPC ..... *E21B 31/107* (2013.01); *E21B 34/14* (2013.01)

(58) Field of Classification Search
CPC ..... E21B 31/005; E21B 31/107; E21B 4/10; E21B 28/00; E21B 2200/06; E21B 2200/04; E21B 34/066; E21B 34/14
See application file for complete search history.

(56) References Cited

U.S. PATENT DOCUMENTS 2,054,255 A * 9/1936 Howard ..... E21B 10/04 175/381
2,072,470 A * 3/1937 Thompson ..... E21B 10/00 175/413
2,641,445 A * 6/1953 Snyder ..... E21B 4/10 175/102
3,396,807 A * 8/1968 Menton ..... E21B 4/10 175/298
6,041,857 A 3/2000 Carmody et al.
6,257,332 B1 7/2001 Vidrine et al.
10,544,657 B2 * 1/2020 MacDougall ..... E21B 23/01
11,359,457 B2 6/2022 Kent et al.
2007/0221417 A1 * 9/2007 Hall ..... E21B 4/06 175/415
2014/0174726 A1 * 6/2014 Harrigan ..... E21B 31/005 166/177.2

(Continued)

FOREIGN PATENT DOCUMENTS

CN 209908400 1/2020
CN 211115883 7/2020

(Continued)

OTHER PUBLICATIONS

International Search Report and Written Opinion for International Patent Application No. PCT/US2022/047910 dated Jul. 7, 2023.

*Primary Examiner* — Kipp C Wallace

(74) *Attorney, Agent, or Firm* — Scott Richardson; C. Tumey Law Group PLLC

(57) ABSTRACT

Systems and methods of the present disclosure relate to actuator assemblies for downhole tools. An actuator assembly comprises a motor, a spring and a hammer. The spring is adjacent to the hammer, and the hammer operable to compress the spring. The spring is operable to expand. The assembly also includes an anvil adjacent to the hammer. The anvil is operable to move a portion of the downhole tool.

17 Claims, 5 Drawing Sheets

(56) References Cited

U.S. PATENT DOCUMENTS

| | | | | |
|---|---|---|---|---|
| 2017/0167227 | A1* | 6/2017 | Lee | E21B 28/00 |
| 2018/0163474 | A1 | 6/2018 | Kartha et al. | |
| 2020/0332615 | A1* | 10/2020 | Wiesenborn | E21B 31/1135 |

FOREIGN PATENT DOCUMENTS

| | | |
|---|---|---|
| WO | 82-01569 | 5/1982 |
| WO | 1996010123 | 4/1996 |

* cited by examiner

INTEGRATION OF STORED KINETIC ENERGY IN DOWNHOLE ELECTRICAL INTERVAL CONTROL VALVES

BACKGROUND

Electrical downhole tools may operate with limited power due to downhole conditions, infrastructure, and power transmission losses. Further, speed and torque must be balanced, as low torque with high speed may not always move the electrical interval control valve (E-ICV) sleeve or ball valve, and high torque results in low operating speed that may be unacceptable to end users and limit the utility of the downhole tool. This limits the ability of downhole tools, to supply adequate torque to overcome static friction and obstructions due to scaling or asphalt deposition.

BRIEF DESCRIPTION OF THE DRAWINGS

These drawings illustrate certain aspects of some examples of the present disclosure and should not be used to limit or define the disclosure.

DETAILED DESCRIPTION

Figure 1:
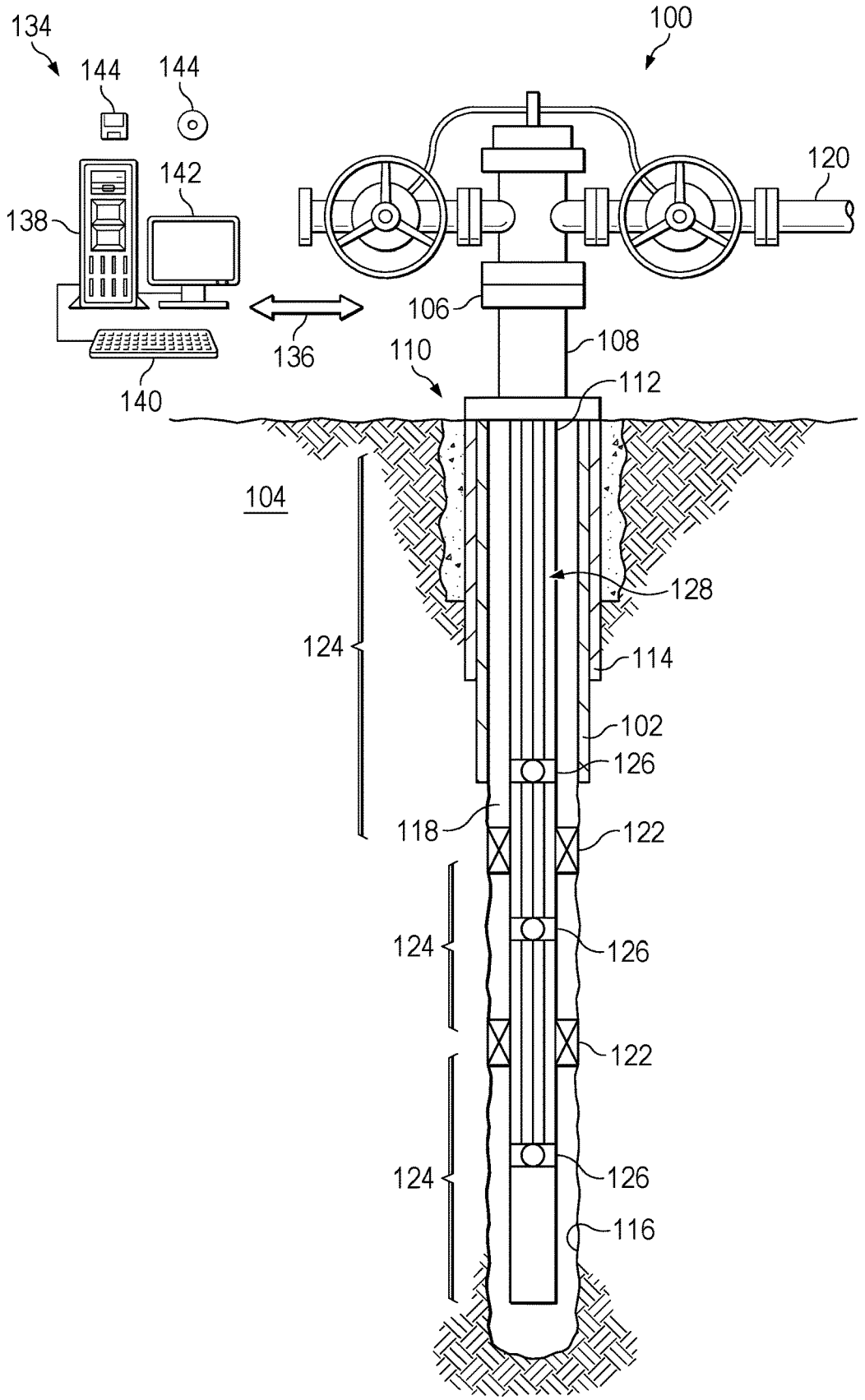
FIG. 1 illustrates an operating environment for an actuator assembly that integrates stored kinetic energy in downhole E-ICVs, in accordance with examples of the present disclosure.

The present disclosure relates to an actuator assembly for downhole tools such as E-ICVs, ball valves, or other tools requiring linear actuation. Specifically, the actuator assembly employs an impact mechanism to overcome high friction, by producing an instantaneous force. This force includes an impact produced by using stored kinetic energy supplied by an existing motor.

The actuator assembly uses a spring, a hammer, and an anvil, similar to an impact driver and/or a hammer drill. The spinning hammer stores the kinetic energy and utilizes the kinetic energy to produce an impact against the anvil, producing a very high instantaneous torque. The hammer striking the anvil produces actuation forces at a linear actuator, such as a screw or similar to a jack screw and nut or a ball screw and/or ball nut to overcome friction and/or obstructions preventing movement of a sliding sleeve in the E-ICV.

The impact force on the sleeve to overcome high static friction is an improvement to existing E-ICV's power and transmission setup. Existing actuator assemblies rely on providing additional power to the motor to develop more torque or creating a power train with a lower gear ratio, resulting in lower operating speeds and greater losses due to friction in the power train, and overall slower tool actuation.

The impact driver and impact wrench mechanisms each allow the valve to open and close quickly under favorable conditions but allows for extremely high torque when required to dislodge or remove obstructions that are preventing the sliding sleeve from moving (e.g., resistance). The impact produces an instant high force which traditional motors struggle to achieve, given power restriction in downhole tools to overcome any additional friction due to debris or scaling issues.

In some examples, an impact driver configuration may be employed. The spring and the hammer are connected to a side of the assembly that has the motor, and the anvil is positioned on a side that has a ball screw nut. The hammer and the anvil (e.g., the anvil may be a part of the ball screw nut) rotate to move the ball screw back and forth in a linear direction, which in turn moves the carrier back and forth. A drive tube may be rotated by the motor via a gearbox. The hammer may be movably disposed around the drive tube. The anvil is positioned axially in front of the hammer. Rotation of the drive tube is transferred to the anvil via the hammer.

The impact/hammering action occurs when there is resistance to moving the sleeve (e.g., sliding sleeve valve). The resistance causes the spring to compress against the hammer, allowing the hammer to climb over portions of the anvil. For example, when a load on the anvil exceeds a predetermined/threshold value, the hammer moves backward (temporarily disengages from the anvil) toward the motor to compress a spring and allow the hammer to spin freely, and thereafter suddenly moves the hammer forward due to expansion of the spring, to reengage/strike the anvil (e.g., impact force/hammering the anvil), thereby allowing for intermittent impact to the anvil during rotation of the hammer to produce a very high torque in the drive mechanism. #

The operation may be similar to that of an impact driver. For example, the spring may be compressed every half turn, and then is released, allowing the hammer to subsequently spin and drive the anvil forward. The energy is directed from the hammer rotationally against the anvil to axially move the sleeve forward. That is, once over the anvil, the hammer spins quickly, storing kinetic energy similar to a flywheel, and strike the anvil, supplying all of the kinetic energy to the anvil in a single pulse, imparting tremendous torque to the ball screw, allowing the sliding sleeve to break any static friction, scrape adherent debris from the sliding surfaces, and/or crushing obstructions.

FIG. 1 illustrates an example of a well system 100 with isolated production zones. Well system 100 may comprise a wellbore 102 formed within a formation 104. Wellbore 102 may be a vertical wellbore as illustrated or it may be a horizontal and/or a directional well. While well system 100 may be illustrated as land-based, it should be understood that the present techniques may also be applicable in offshore applications. Formation 104 may be made up of several geological layers and include one or more hydrocarbon reservoirs. As illustrated, well system 100 may include a production tree 106 and a wellhead 108 located at a well site 110. A production tubing 112 may extend from wellhead 108 into wellbore 102, which may traverse formation 104.

Without limitation, wellbore 102 may be cased with one or more casing segments 114. Casing segments 114 help maintain the structure of wellbore 102 and prevent wellbore 102 from collapsing in on itself. In some embodiments, a portion of the well may not be cased and may be referred to as "open hole." The space between production tubing 112 and casing segments 114 or wellbore wall 116 may be an annulus 118. Production fluid may enter annulus 118 from formation 104 and then may enter production tubing 112 from annulus 118 through sliding sleeve valve 126. Production tubing 112 may carry production fluid uphole to production tree 106. Production fluid may then be delivered to various surface facilities for processing via a surface pipeline 120.

Wellbore 102 may be separated into a plurality of zones with packers 122 disposed in annulus 118. Packers 122 may separate wellbore 102 into zones 124. At least a portion of production tubing 112 may be disposed within at least one zone 124 and at least one sliding sleeve valve 126 may be disposed in zone 124. During operations, when sliding sleeve valve 126 is open, fluid may flow from the respective zone 124 into production tubing 112. When a sliding sleeve valve 126 is closed, fluid from the respective zone 124 is prevented from flowing into production tubing 112. Thus, the flow of formation fluid from each zone 124 into production tubing 112 may be controlled through the actuation of a sliding sleeve valve 126. In examples, the flow of fluid may be increased or decrease incrementally by "choking" a sliding sleeve valve 126. Choking a sliding sleeve valve 126 may be defined as partially opening or partially closing a sliding sleeve valve 126. During operations, a sliding sleeve valve 126 may be at least partially open or at least partially closed by twenty five percent, fifty percent, or seventy five percent. Additionally, production tubing valves 126 may be fully opened, fully closed, or positioned between one percent and ninety nine percent open or closed.

The sliding sleeve valve 126 may be operated/powered electrically and controlled by an actuator assembly 128. The actuator assembly 128 is connected to a computer 134 through connection 136, which may be wired or wireless. The computer 134 may be used to provide power to the actuator assembly 128 via a power source. Systems and methods of the present disclosure may be implemented, at least in part, with the computer 134 that may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, the computer 134 may be a processing unit 138, a network storage device, or any other suitable device and may vary in size, shape, performance, functionality, and price. The computer 134 may include random access memory (RAM), one or more processing resources such as a central processing unit (CPU) or hardware or software control logic, ROM, and/or other types of nonvolatile memory. Additional components of the computer 134 may include one or more disk drives, one or more network ports for communication with external devices as well as an input device 140 (e.g., keyboard, mouse, etc.) and video display 142. The computer 134 may also include one or more buses operable to transmit communications between the various hardware components.

Alternatively, systems and methods of the present disclosure may be implemented, at least in part, with non-transitory computer-readable media 144. Non-transitory computer-readable media 144 may include any instrumentality or aggregation of instrumentalities that may retain data and/or instructions for a period of time. Non-transitory computer-readable media 144 may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such as wires, optical fibers, microwaves, radio waves, and other electromagnetic and/or optical carriers; and/or any combination of the foregoing.

Figure 2:
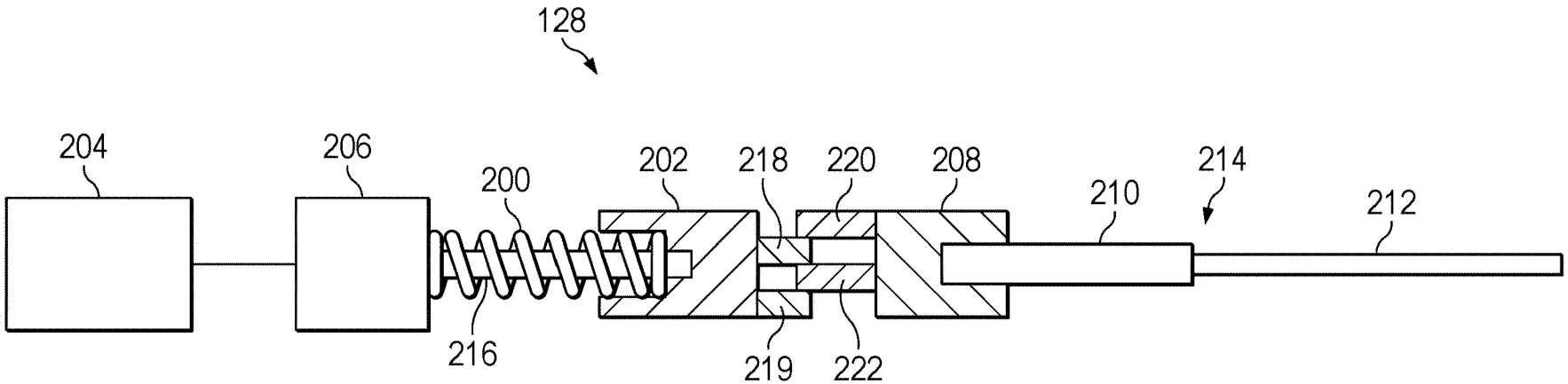
FIG. 2 illustrates a side view of an actuator assembly including an impact driver configuration, in accordance with examples of the present disclosure.

FIG. 2 illustrates a close-up view of the actuator assembly 128, in accordance with some examples of the present disclosure. The actuator assembly 128 may include an impact driver configuration. For example, a spring 200 and a hammer 202 are connected to a side of the assembly that has the motor 204 and a gearbox 206, and an anvil 208 is positioned on a side that has a ball screw nut 210. The hammer 202 and the anvil 208 (as part of the ball screw nut 210) rotate (driven by the motor 204), moving the ball screw 214 back and forth, which in turn moves a carrier 212 back and forth. The carrier 212 may be disposed on an end of the ball screw 214 and may include a sleeve or an elongated member for sleeve attachment.

In some examples, a drive tube 216 may be rotated by the motor 204 via the gearbox 206. The hammer 202 may be movably disposed around or adjacent to the drive tube 216. The anvil 208 is positioned axially in front of the hammer 202. Rotational motion of the drive tube 216 is transferred to the anvil 208 via the hammer 202.

The impact/hammering occurs when there is resistance to moving the carrier 212 (e.g., stuck sleeve) in axial directions. The resistance causes the hammer 202 to move backward toward the gearbox 206 which in turn compresses the spring 200. For example, when a load on the anvil 208 exceeds a predetermined/threshold value, the hammer 202 moves backward (temporarily disengages from the anvil 208) toward the gearbox 206 to compress the spring 200.

Thereafter, the hammer 202 spins freely and suddenly moves forward due to expansion/release of the spring 200, to reengage/strike the anvil 208 (e.g., impact drive force), thereby allowing for intermittent impact to the anvil 208 during rotation of the hammer 202. #That is, #portion 218 (protrusion) of the hammer 202 rotates and climbs over portion 220 (protrusion) of the anvil 208 to engage portion 222 (protrusion) of the anvil 208 during reengagement/impact and rotation. The hammer 202 may include multiple portions such as the portion 218 and the portion 219 each operable to climb over the portions 220 and 222 of the hammer 202 during striking and rotation.

The spring 200 may be compressed every half turn, for example, and then is released, delivering force to the hammer 202 to subsequently spin and drive the anvil 208 forward. The energy is directed from the hammer 202 rotationally against the anvil 208 to axially move the carrier 212 forward away from the gearbox 206. That is, once over the portion 220 of the anvil 208, the hammer 202 spins quickly, (the hammer stores and releases kinetic energy similar to a flywheel) and strikes and urges rotation of the portion 222 of the anvil 208, supplying all of the kinetic energy to the anvil 208 in a single pulse, imparting tremendous torque to the ball screw 214, allowing a sliding sleeve (see FIG. 3) to break any static friction, scrape adherent debris from the sliding surfaces, and/or crushing obstructions.

Figure 3:
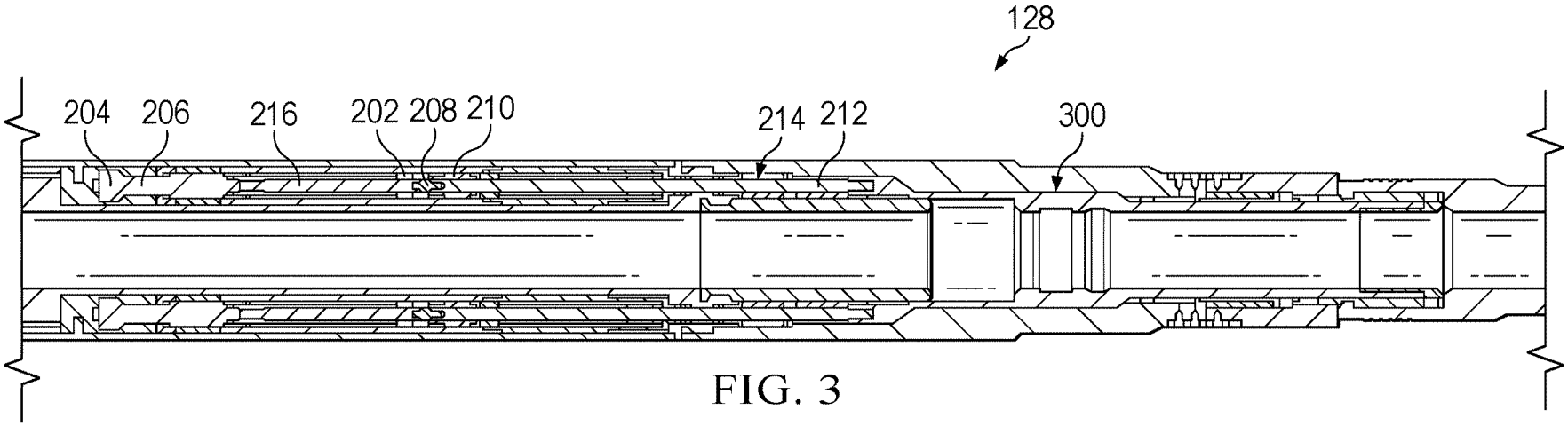
FIG. 3 illustrates a sleeve for an actuator assembly, in accordance with examples of the present disclosure.

FIG. 3 illustrates the actuator assembly 128 coupled to a sliding sleeve 300, in accordance with examples of the present disclosure. As set forth above, the spring (shown on FIG. 2) and the hammer 202 are connected to a side of the assembly that has the motor 204 and the gearbox 206, and the anvil 208 is positioned on the side that has the ball screw nut 210. The hammer 202 and the anvil 208 (as part of the ball screw nut 210) rotate due to the motor 204, thereby moving the ball screw 214 back and forth, which in turn moves the carrier 212 and the sleeve 300 back and forth. The carrier 212 may be disposed on an end of the ball screw 214.

For example, the drive tube 216 may be rotated by the motor 204 via the gearbox 206. The hammer 202 may be movably disposed around or adjacent to the drive tube 216. The anvil 208 is positioned axially in front of the hammer 202. Rotational motion of the drive tube 216 is transferred to the anvil 208 via the hammer 202. The impact/hammering occurs when there is resistance to moving the sleeve 300. The resistance causes the hammer 202 to move backward toward the gearbox 206 which in turn compresses the spring 200.

For example, when a load on the anvil 208 exceeds a predetermined/threshold value, the hammer 202 moves backward (temporarily disengages from the anvil 208) along the drive tube 216 to compress the spring 200, and thereafter is suddenly released to move forward due to expansion of the spring 200, to strike the anvil 208 (e.g., impact drive force), thereby allowing for intermittent impact to the anvil 208 during rotation of the hammer 202. #

The spring 200 may be compressed every half turn, for example, and then is released, delivering force to the hammer 202 to subsequently spin and drive the anvil 208 forward. The energy is directed from the hammer 202 rotationally against the anvil 208 to axially move the carrier 212 forward. That is, once over the portion 220 of the anvil 208, the hammer 202 spins quickly, (the hammer stores and releases kinetic energy similar to a flywheel) and strikes the portion 222 of the anvil 208, supplying all of the kinetic energy to the anvil 208 in a single pulse, imparting torque to the ball screw 214, allowing the sliding sleeve 300 to break static friction, scrape adherent debris from the sliding surfaces, and/or crushing obstructions.

Figure 4:
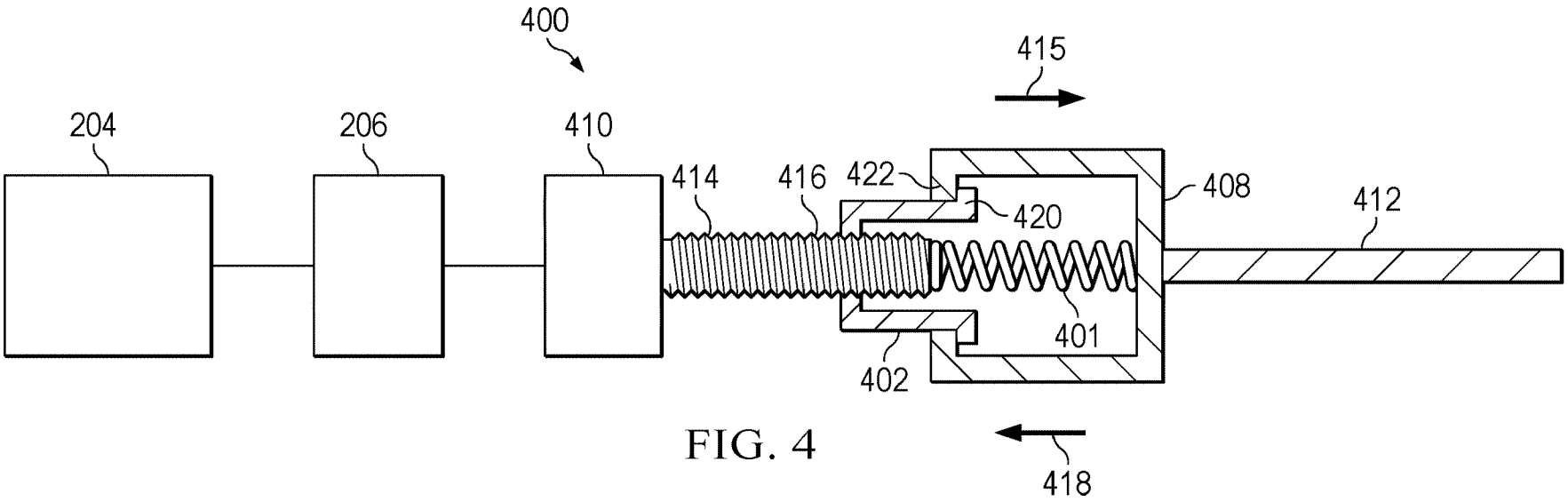
FIG. 4 illustrates a side view of an alternative actuator assembly with a hammer drill configuration, in accordance with examples of the present disclosure.

FIG. 4 illustrates a close-up view of an actuator assembly 400 including the hammer drill configuration, in accordance with some examples of the present disclosure. Instead of the impact driver configuration being added before the ball screw nut 410 as shown on FIGS. 2 and 3, the hammer drill configuration can be added between the ball screw 414 and the carbide carrier 412 (e.g., a sleeve). The spring 401 and a hammer 402 may be connected to the ball screw side, and the anvil 408 may be connected to the carbide carrier side.

To push the carbide carrier 412 in a forward direction 415, the motor 204 via the gearbox 206 rotates the ball screw nut 410 to axially move the ball screw 414 to compress the spring 401 between the hammer 402 and the anvil 408 to drive the carbide carrier 412 forward. The anvil 408 surrounds at least a portion of the hammer 402. That is, in some examples, at least a portion of the hammer 402 moves axially within the anvil 408.

With nominal motor torque, if the carrier 412 is not moving (e.g., the sleeve encounters resistance), then the impact force is generated. For example, the impact/hammering occurs when there is resistance to moving the carrier 412. The resistance causes the spring 401 to compress, and then is allowed to expand (released) such that the hammer 402 strikes the anvil 408. The hammer 402 is connected to a shaft 416 that pulls the carrier 412 and the anvil 408 backward toward the gearbox 206 as the hammer 402 strikes the anvil 408 in a backward direction 418.

The hammer 402 may move within the anvil 408 to push and pull the anvil 408, as shown. Portions 420 of the hammer 402 may contact portions 422 of the anvil 408 to prevent separation therebetween. For example, when a load on the anvil 408 exceeds a predetermined/threshold value, the hammer 402 moves backward as the spring 401 expands, to strike the anvil 408 (e.g., impact drive force), thereby allowing for intermittent impact to the anvil 408 to overcome any resistance the carbide carrier 412 may encounter. #

Figure 5:
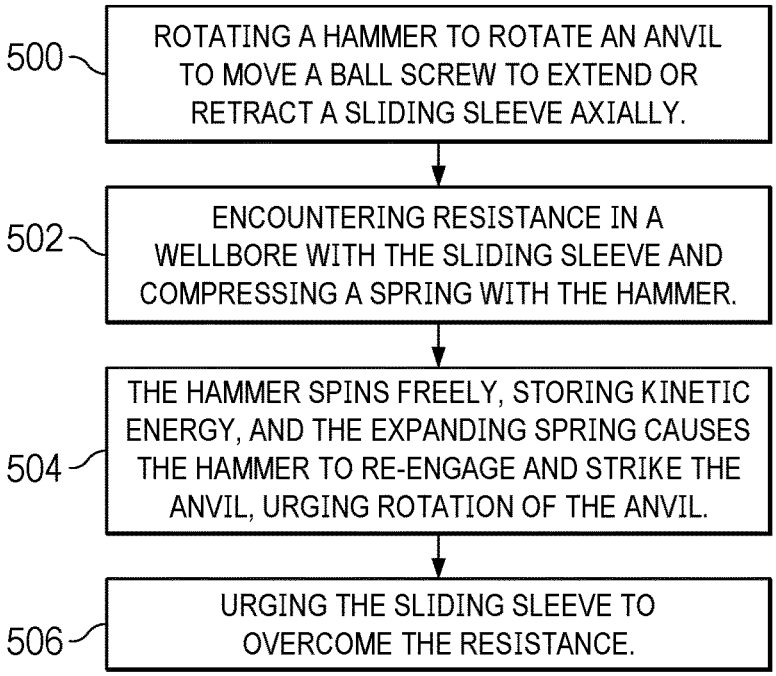
FIG. 5 illustrates an operative sequence for the actuator assembly with an impact driver configuration, in accordance with examples of the present disclosure.

FIG. 5 illustrates an operative sequence for actuating a sliding sleeve valve with stored kinetic energy, in accordance with examples of the present disclosure. At step 500, in the impact driver configuration, rotation of the hammer occurs to rotate the anvil to axially move the ball screw to move the carbide carrier and the sleeve in axial directions (extension or retraction), as shown on FIGS. 2 and 3, for example. The hammer and the anvil (as part of the ball screw nut) rotate, moving the ball screw back and forth, which in turn moves the carrier and the sleeve back and forth axially.

At step 502, the sleeve encounters resistance in the wellbore causing the hammer to compress a spring. For example, when a load on the anvil exceeds a predetermined/threshold value (stuck sleeve), the hammer moves backward (temporarily disengages from the anvil) to compress the spring.

At step 504, the hammer spins freely, storing kinetic energy. The spring is released/expanded to cause the hammer to re-engage and strike the anvil. That is, the hammer is suddenly released to move forward due to expansion of the spring, to strike the anvil (e.g., impact drive force to urge rotation of the anvil), imparting the stored kinetic energy in a pulse to the anvil, thereby allowing for intermittent impact to the anvil during rotation of the hammer. #Operation may be similar to that of an impact driver.

At step 506, the impact from the hammer urges the sliding sleeve to break static friction, scrape adherent debris from the sliding surfaces, and/or crush obstruction. That is, once over the portions of the anvil, the hammer spins quickly and strikes the portion of the anvil, supplying all of the kinetic energy to the anvil in a single pulse, imparting torque to the ball screw to move the sleeve.

Figure 6:
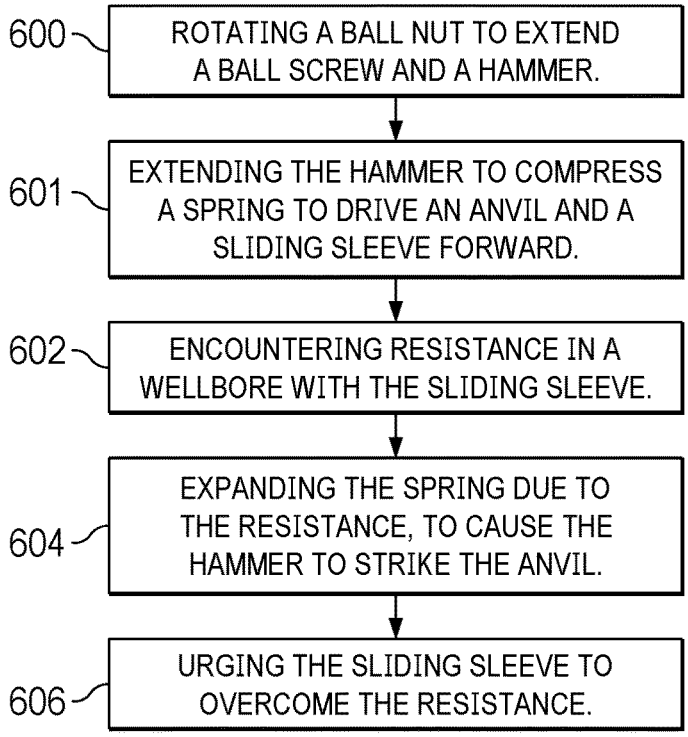
FIG. 6 illustrates an operative sequence for the actuator assembly with a hammer drill configuration, in accordance with examples of the present disclosure.

FIG. 6 illustrates an operative sequence for actuating a sliding sleeve valve with stored kinetic energy, in accordance with examples of the present disclosure. At step 600, in the hammer drill configuration of FIG. 4, the ball nut is rotated to move the ball screw.

At step 601, extension of the ball screw causes the hammer to compress the spring to drive the anvil and carrier/sleeve forward. The hammer may also pull the carrier/sleeve and anvil backward (retraction) via a shaft.

To push the carbide carrier in a forward direction, the hammer compresses the spring during rotation of the motor to move the anvil and carbide carrier forward. The motor rotates the ball screw nut to axially move the ball screw to maintain compression on the spring to push the anvil and the carbide carrier forward. The anvil surrounds at least a portion of the hammer. That is, in some examples, at least a portion of the hammer moves axially within the anvil.

At step 602, the sleeve encounters resistance in the wellbore. With nominal motor torque, if the carrier is not moving (e.g., the sleeve encounters resistance), then the impact force is generated. For example, the impact/hammering occurs when there is resistance to moving the carrier.

At step 604, the resistance causes the spring to expand (released) such that the hammer strikes the anvil. For example, the spring expands causing the hammer to strike the anvil in a backward direction. The hammer may move within the anvil to push and pull the anvil, as shown. Portions of the hammer may contact portions of the anvil to prevent separation therebetween. When a load on the anvil exceeds a predetermined/threshold value, the hammer moves backward as the spring expands, to strike the anvil, thereby allowing for intermittent impact to the anvil to overcome any resistance the carbide carrier may encounter. #That is, the hammer is suddenly released to move backward due to expansion of the spring, to strike the anvil (e.g., hammer drill force to urge axial movement of the sleeve). #Operation may be similar to that of a hammer drill.

At step 606, the impact from the hammer urges the sliding sleeve to break static friction, scrape adherent debris from the sliding surfaces, and/or crush obstruction. That is the hammer strikes the anvil, supplying all of the stored energy to the anvil in a single pulse, to move the sleeve.

Accordingly, the systems and methods of the present disclosure allow for impact mechanisms to control downhole tools such as for example, to actuate sliding sleeve valves or ball valves in wellbores. The systems and methods may include any of the various features disclosed herein, including one or more of the following statements.

Statement 1. A downhole tool comprising: a motor; a spring and a hammer, the spring adjacent to the hammer, the hammer operable to compress the spring, the spring operable to expand; an anvil adjacent to the hammer, the anvil operable to move a portion of the downhole tool.

Statement 2. The downhole tool of the statement 1, wherein the hammer is operable to strike the anvil to transfer stored kinetic energy from the spring.

Statement 3. The downhole tool of the statement 1 or the statement 2, wherein the hammer is operable to strike the anvil to transfer stored kinetic energy from the hammer.

Statement 4. The downhole tool of any one of the statements 1-3, wherein the hammer and the anvil include protrusions.

Statement 5. The downhole tool of any one of the statements 1-4, wherein the movable portion includes a sleeve.

Statement 6. The downhole tool of any one of the statements 1-5, further comprising a gearbox coupled to the hammer wherein the spring is disposed between the gearbox and the hammer.

Statement 7. The downhole tool of any one of the statements 1-6, wherein the spring is disposed between the gearbox and the hammer.

Statement 8. The downhole tool of any one of the statements 1-7, wherein the sleeve is a component of an electrical interval control valve Statement 9. A method comprising: rotating a hammer that is adjacent to an anvil; rotating the anvil due to contact with the hammer; encountering, with a downhole tool, resistance in a wellbore; compressing a spring with the hammer due to the resistance; releasing the spring; and striking the anvil with the hammer to overcome the resistance.

Statement 10. The method of the statement 8, wherein the hammer is rotated with a motor.

Statement 11. The method of the statement 8 or 9, further comprising controlling a downhole electrical interval control valve with a sleeve of the downhole tool.

Statement 12. The method of any one of the statements 8-11, further comprising controlling fluid flow in the wellbore with the sleeve.

Statement 13. The method of any one of the statements 8-12, wherein the resistance includes static friction and obstructions due to scaling or asphalt deposition.

Statement 14. A method comprising: rotating a component; extending the hammer to compress a spring upon rotation of the component; driving an anvil and a portion of a downhole tool forward upon extension of the hammer; encountering, with the downhole tool, resistance in a wellbore; expanding the spring due to the resistance; and striking the anvil with the hammer to overcome the resistance.

Statement 15. The method of the statements 14, wherein the component is rotated with a motor.

Statement 16. The method of the statement 14 or the statement 15, wherein the component includes a nut.

Statement 17. The method of any one of the statements 14-16, wherein the downhole tool includes a sleeve that encounters the resistance.

Statement 18. The method of any one of the statements 14-17, further comprising extending or retracting a carbide carrier that is attached to the sleeve.

Statement 19. The method of any one of the statements 14-18, further comprising controlling fluid flow in the wellbore with the sleeve.

Statement 20. The method of any one of the statements 14-19, wherein the resistance includes static friction and obstructions due to scaling or asphalt deposition.

Although the present disclosure and its advantages have been described in detail, it should be understood that various changes, substitutions, and alterations may be made herein without departing from the spirit and scope of the disclosure as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A downhole tool comprising:

a downhole valve having a sleeve;

a spring operable to compress and expand;

a hammer, adjacent to the spring, wherein the hammer is operable to compress the spring;

a motor, operable to rotate the hammer, and an anvil, adjacent to the hammer, operable to rotate with the hammer in a first mode of operation and to be struck by the hammer in second mode of operation, wherein the anvil is operable to move the sleeve in both the first mode of operation and the second mode of operation.

2. The downhole tool of claim 1, wherein the hammer is operable to strike the anvil to transfer kinetic energy from the hammer.

3. The downhole tool of claim 2, wherein the hammer comprises a first portion.

4. The downhole tool of claim 1, wherein the downhole valve is an electrical interval control valve.

5. The downhole tool of claim 1, wherein the downhole tool further comprises:

a gearbox coupled to the hammer.

6. The downhole tool of claim 5, wherein the spring is disposed between the gearbox and the hammer.

7. The downhole tool of claim 5, wherein the gearbox is coupled to the hammer via a drive tube.

8. The downhole tool of claim 7, wherein the spring surrounds the drive tube.

9. The downhole tool of claim 3, wherein the anvil comprises a second portion.

10. The downhole tool of claim 9, wherein the first portion is operable to strike the second portion.

11. A method comprising:

rotating a hammer with a motor to contact an anvil;

rotating the anvil due to the contact with the hammer;

encountering a resistance when rotating the anvil;

compressing a spring, with the hammer, due to the resistance;

expanding the spring; and striking the anvil, with the hammer, to overcome the resistance, causing a sleeve to move due to overcoming the resistance, and controlling fluid flow in a wellbore with the sleeve.

12. The method of claim 11, wherein the resistance is caused by static friction or obstructions.

13. The method of claim 11, wherein after compressing the spring, the method further comprises:

rotating the hammer while the anvil does not rotate.

14. The method of claim 13, wherein after striking the anvil, the method further comprises:

rotating the anvil due to the hammer striking the anvil.

15. The method of claim 14, wherein the resistance is overcome by rotating the anvil.

16. The method of claim 11, wherein compressing the spring is caused by the hammer moving away from the anvil.

17. The method of claim 16, wherein the hammer maintains kinetic energy while compressing the spring.

* * * * *